United States Patent [19]

Agnew et al.

[11] Patent Number: 4,491,515

[45] Date of Patent: Jan. 1, 1985

[54] TREATING USED AUTOMOTIVE LUBRICATING OIL TO REDUCE THE CONTENT OF SUSPENDED PARTICULATE MATTER, INCLUDING LEAD

[75] Inventors: John B. Agnew, Glen Waverley; John A. Barnard, Mount Waverley; Viyada Tirtaatmadja, Mulgrave, all of Australia

[73] Assignee: Monash University, Victoria, Australia

[21] Appl. No.: 360,055

[22] Filed: Mar. 19, 1982

[30] Foreign Application Priority Data

Mar. 23, 1981 [AU] Australia ..... PE8105
Jan. 14, 1982 [AU] Australia ..... PF2287

[51] Int. Cl.[3] ..... C10M 11/00
[52] U.S. Cl. ..... 208/180; 208/181
[58] Field of Search ..... 208/180, 177, 181, 183

[56] References Cited

U.S. PATENT DOCUMENTS 1,584,588 5/1926 Acheson ..... 208/180
3,763,036 10/1973 Jordan et al. ..... 208/180
3,819,508 6/1974 Fainman et al. ..... 208/180
3,835,035 9/1974 Fainman et al. ..... 208/183
4,028,226 6/1977 Forsberg ..... 208/180
4,073,719 2/1978 Whisman et al. ..... 208/184
4,204,946 5/1980 Johnson ..... 208/181

*Primary Examiner*—Delbert E. Gantz
*Assistant Examiner*—Anthony McFarlane
*Attorney, Agent, or Firm*—Larson and Taylor

[57] ABSTRACT

Process for treating used lubricating oil to reduce the content of suspended particulate matter therein, characterized by contacting said used lubricating oil with a carbonyl-group containing compound in the presence of an aqueous electrolyte, separating the resulting mixture into an upper layer containing clarified oil and a lower layer containing agglomerated particulates, and recovering oil of reduced particulate content as product. Suitable carbonyl-group containing compounds include ketones, esters and aldehydes and suitable electrolytes include inorganic and organic acids, alkalis and salts.

10 Claims, No Drawings

TREATING USED AUTOMOTIVE LUBRICATING OIL TO REDUCE THE CONTENT OF SUSPENDED PARTICULATE MATTER, INCLUDING LEAD

This invention relates to treatment of used automotive lubricating oil.

The importance of conserving crude oil products is emphasised at the present time by the constantly increasing price of crude oil and the possibility of uncertain supply in circumstances beyond the control of the consumer. Conservation of lubricating oil in Australia is of particular importance as indigenous crude is deficient in heavy fractions as compared with traditional, e.g. Middle East, sources.

Automotive lubricating oil becomes contaminated during use and consequently must be periodically removed and replaced. However, as the oil itself has not been consumed, the used oil (commonly referred to as "waste oil") constitutes a valuable resource that should not be discarded.

Used automotive lubricating oil contains a large number of contaminants, including water, light hydrocarbons, oil oxidation products and suspended particulates, as well as extraneous substances which are added during collection. The particulates usually consist of aggregates of carbonaceous material and compounds of lead, produced in the combustion of leaded petrol, as well as small quantities of wear metals. The particulates are small in size, generally less than 1 micrometer. They are kept in suspension by dispersant compounds deliberately added to the fresh lubricating oil in its formulation.

An essential step in regenerating the so-called waste oil for re-use is to remove these suspended particulates. Modern dispersant additives are so successful in keeping particulates in suspension in the oil that removing them has become a difficult problem. Numerous different procedures have been tried, including solvent treatment, acid and alkali washing and high-temperature distillation, with only moderate success. The addition of methyl ethyl ketone (MEK) as proposed in U.S. Pat. No. 3,763,036 has been found to result in slow agglomeration of particulates which may then be removed by gravity settling or by centrifugal separation.

The present invention provides a rapid and convenient process for agglomerating and separating suspended particulate matter, including lead, from hydrocarbon lubricating oils used in internal combustion engines.

It will be understood that we use the term "agglomeration" in the sense that includes the phenomenon more strictly referred to as flocculation.

In a general aspect the invention provides a process for treating used lubricating oil to reduce the content of suspended particulate matter therein, characterised by contacting said used lubricating oil with a carbonyl-group containing compound in the presence of an aqueous electrolyte, separating the resulting mixture into an upper layer containing clarified oil and a lower layer containing agglomerated particulates, and recovering clarified oil as product.

The carbonyl-group containing compound may for example be a ketone, an ester or an aldehyde. Preferred carbonyl-group containing compounds are solvents such as methyl isobutyl ketone (MIBK), methyl ethyl ketone (MEK) or ethyl acetate. Mixtures of carbonyl-group containing compounds may be used.

Suitable electrolytes may be acids, alkalis and salts. Preferred electrolytes include organic or inorganic acids, such as acetic, hydrochloric, sulphuric and carbonic acid; alkalis such as sodium hydroxide, potassium hydroxide and ammonium hydroxide; and salts such as sodium chloride, sodium sulphate, ammonium chloride, ammonium sulphate, ferrous chloride, and aluminum sulphate. Mixtures of electrolytes may also be used.

The process may be carried out at any convenient temperature, for example from 15° C. to 60° C.

The solvent-to-oil ratio may be at least 1:1, preferably between about 1.5:1 and 4:1.

Separation of agglomerated particulates from the oil may be effected by any convenient means, for example, gravity settling, centrifuging or filtration. Gravity settling may be conducted, for example, between 0.5 and 2 hours. The ketone (or other carbonyl-group containing solvent) is readily recovered from the separated solvent-oil layer by standard means such as distillation and is available for re-use. The electrolyte, if volatile, can also be recovered simultaneously. If a non-volatile acid such as sulphuric acid is used, the acid may be neutralized by subsequent alkali wash, for example with dilute aqueous caustic soda or ammonia. The secondary treatment with alkali can result in further precipitation which may or may not necessitate separation by the means previously described. It will be appreciated that this constitutes a two-stage treatment, namely an acid treatment followed by an alkali treatment.

The invention thus also contemplates successive treatments employing different reagents, for example alkali treatment followed by acid treatment.

The separated sludge may be washed with fresh or recovered solvent to remove adhering oil, then filtered and dried to yield a dry powder which can be disposed of or further processed to recover lead.

Mixing of the waste oil and solvent can be achieved by standard means such as "in-line" mixing or mechanical agitation.

The process of the invention may be carried out on a batch or a continous basis.

Although we do not wish to be limited by any theoretical or postulated mechanism for the observed beneficial effects, we believe it likely that the carbonyl-group containing compound functions to solubilize the added dispersant which is adhering to the particulate phase and thus preventing it from agglomerating. The aqueous electrolyte may provide ions which neutralize the surface charge on the particles which have been freed of protecting dispersant molecules, thereby facilitating accelerated agglomeration of the particles to yield large clumps which settle rapidly.

The ability of a small quantity of aqueous electrolyte to cause rapid agglomeration of particulates when added in the presence of a carbonyl-group containing compound such as ketone is surprising, since acids or alkalis alone are ineffectual and most common organic solvents such as kerosine, benzene and alcohols, to which electrolytes have been added, are also ineffectual. However, we have found that certain classes of liquid organic compounds which are related structurally to ketones, such as esters and aldehydes, are also effective in the presence of aqueous electrolytes, but in varying degrees, the common structural feature being the presence of a carbonyl group. Another surprising feature is that aqueous inorganic acids which are only slightly soluble in ketones or the other carbonyl-group containing solvents are at least as effective as organic acids such as acetic acid.

Another feature of the invention is that elevated temperatures in the order of 60° C.–150° C. as used in other purifying processes are not required. Our method preferably employs temperatures in the order of 15° C. to 60° C., thereby affording a saving in processing costs.

Another feature of the invention is that a low volume ratio of solvent to oil, for example 1.5:1 is effective. This low ratio means that the cost of recovery of the solvent is reduced. Even lower solvent to oil ratios may be used. However, these result in a reduced particulate removal and higher lead content.

A further feature of the invention is that water need not be removed from the waste oil prior to treatment, as water is an essential component in effecting agglomeration.

The following examples further illustrate the method of the invention but are not to be construed as limitation thereof.

EXAMPLE 1

This example illustrates the effectiveness of a mixture of MIBK and aqueous acid for treating used oil, compared with other organic solvents containing aqueous acid at the same concentration. The solvents used were n-pentane, kerosine, benzene, methanol, ethanol, i-propanol and n-butanol. The example also illustrates the superiority of the MIBK/aqueous acid combination over pure MIBK and MIBK/aqueous alkali.

The primary procedure was as follows:

To a 100 $cm^3$ test-tube was added 75 $cm^3$ of MIBK, or other organic solvent as listed above, and 1 $cm^3$ of 80% $H_2SO_4$. The solvent and acid were then mixed throughly. The acid represented about 2.8% w/w of the solvent system. 23 $cm^3$ of waste lubricating oil was then added to the acidic solvent system and the resultant mixture shaken vigorously for 1–2 minutes to assure uniform contact between the used oil and solvent. The mixture was then left undisturbed for 30 minutes and in some cases up to 1 hour.

In a comparative procedure, 75 $cm^3$ of pure MIBK was used, the subsequent steps being the same.

In another comparative procedure 75 $cm^3$ of MIBK was mixed with 1 $cm^3$ of 21% w/w $NH_4OH$, instead of acid, the subsequent steps being the same.

With the MIBK and acid, agglomerated particulates could be seen settling down rapidly, forming a descending interface between an upper clarified, dark red, oil-solvent mixture and a lower layer of opaque liquor containing suspended matter. The agglomeration and thus settling of contaminants was relatively rapid. Within 30 minutes, the agglomerated particulates settled to the bottom of the test-tube to form a compact lead-containing sludge of less than 10% of the total volume. The clear oil-solvent mixture occupied the remaining volume.

Of the solvents other than MIBK, n-pentane and kerosine are miscible with the waste oil but most alcohols are only sparingly miscible with oil at ambient temperature. None of these either alone or in combination with aqueous acid or alkali, produced a clear oil-solvent layer; only a very small amount of very fine precipitated sludge was found at the bottom of the test-tube at the end of the settling period. Moreover, the waste-oil-solvent mixture remained very black and opaque in appearance indicating the ineffectiveness of these solvent systems in removing suspended particulate matter, including lead, from the waste oil.

EXAMPLE 2

This example gives a comparison of the effectiveness of different ketones plus an acid, for treating waste oil. The primary procedure of example 1 was repeated utilizing the following ketones: acetone, methyl ethyl ketone (MEK), methyl propyl ketone (MPK), methyl isobutyl ketone (MIBK) and diethyl ketone (DEK). As with example 1, 2.8% w/w of 80% $H_2SO_4$ was added to the ketone. Acetone was found not to be completely miscible with the waste oil; it was not effective in clarifying the waste oil. The other ketones listed above were all completely miscible with waste oil and, in the acidified form, caused rapid agglomeration of suspended matter and thus its settling out from the waste oil. The clarified oil-solvent mixture was then decanted off and separated from the lead-containing sludge.

Table 1 shows a comparison of the lead contents of waste oil (containing an initial 0.75% w/w lead in oil) after treatment with the acidified ketones listed.

TABLE 1

Lead content of acidified-ketone-treated waste oil.

| Ketone | % w/w Pb in oil after treatment |
|---|---|
| MEK | 0.021 |
| MPK | 0.019 |
| MIBK | 0.018 |
| DEK | 0.017 |

The four acidified ketone systems are successful in reducing lead content of waste oil to less than 3% of that originally present in the oil, when treated in the manner described above.

EXAMPLE 3

This example illustrates the effectiveness or otherwise of certain organic liquid compounds which are closely related structurally to ketones in that they contain the carbonyl group $$-\overset{|}{C}=O,$$

and which are miscible with waste oil. The primary procedure of example 1 was repeated using the following: ethyl acetate, n-propyl acetate, n-butyl acetate, n-butyraldehyde, i-butyraldehyde. In each case, 80% $H_2SO_4$ was added so that acid represented about 2.8% w/w of the solvent system.

Acidified ethyl acetate was equally as effective in reducing suspended matter as MIBK and acid, as described in example 1. The clarified waste oil was analysed and found to contain 0.021% w/w lead.

The other esters and aldehydes tested were only partially effective in reducing the amount of suspended matter. Agglomeration and settling were slow, taking longer than one hour to have any noticeable effect.

EXAMPLE 4

This example compares different acids in admixture with MIBK, and the effect of their percentage in the solvent system.

The procedure of example 2 was repeated, with the solvent systems comprising MIBK and several organic (carboxylic) acids used separately. The acids utilized included formic, acetic, propionic, butyric and succinic acid. In all cases the MIBK/acid/water volume ratios where 90/7/3. It was found that they were all successful in treating the waste oil to result in clarified, dark red oil-solvent mixture. Acetic acid was found most successful; it resulted in a concentrated sludge of less than 10% of the total volume within 30 minutes after mixing the oil and the solvent, while the use of MIBK and the other organic acids generally did not result in as rapid a settling rate.

Lead content of waste oil after treatment with MIBK containing aqueous acetic acid in the volume ratio as given above was 0.08% w/w Pb in the oil, which is approximately 10% of that originally present in the oil.

The procedure of example 2 was also repeated utilizing MIBK and two inorganic acids hydrochloric acid (HCl) and sulphuric acid ($H_2SO_4$) in different concentrations. Table 2 shows the results of lead content of waste oil after these treatments.

TABLE 2

Lead content of waste oil after treatment with MIBK containing inorganic acid.

| % w/w HCl solution in solvent | Pb content % w/w 32% HCl | Pb content % w/w 20% HCl | % w/w $H_2SO_4$ soln. in solvent | Pb content % w/w 80% $H_2SO_4$ | Pb content % w/w 50% $H_2SO_4$ |
|---|---|---|---|---|---|
| 0.8 | 0.037 | 0.026 | 1.2 | 0.015 | — |
| 1.9 | 0.032 | 0.028 | 2.4 | 0.018 | 0.018 |
| | | | 4.8 | — | 0.020 |

The data in Table 2 clearly illustrate that a small quantity of strong, inorganic acid in MIBK is successful in substantially reducing lead content of the waste oil. Sulphuric acid is more effective than hydrochloric. It also illustrates the importance of a good balance between the concentration of the acid and its percentage in the solvent, to obtain the maximum reduction in waste oil lead content.

EXAMPLE 5

This example illustrates the importance of the presence of water in the solvent system and also the effects of its presence in waste oil to be treated.

The procedure of example 2 was repeated utilizing MIBK and acetic acid with or without water. It was found that MIBK, acetic acid and water in volume ratio of 90/7/3 gave the best result in terms of rapidity of agglomeration and settling rate and clarity of the resultant oil-solvent mixture. The solvent system without water resulted in very little settled agglomerated particulates and very dark, unclear oil-solvent mixture even after several hours of standing. The addition of too much water in the solvent system caused the formation of a second aqueous phase as the solubility limit of water in MIBK was exceeded. However, it was further found that the presence of extra water in the waste oil to be treated did not significantly affect the performance of the solvent system of MIBK, acetic acid and water. The procedure of Example 2 was also repeated utilizing waste oil which had been premixed with different amounts of water up to 10% w/w. The results are shown in Table 3, which also illustrates the lead contents of the waste oil after treatment with MIBK containing 1.9% w/w of the 32% HCl. In this case the presence of extra water in the waste oil resulted in increasing the amount of lead removal from the oil.

TABLE 3

Lead content of the waste oil containing different amounts of water, after treatment with acidified MIBK.

| % w/w water in waste oil. | Pb content % w/w Solvent:MIBK/HAc/$H_2O$ = 90/7/3. | Pb content % w/w Solvent:MIBK + 1.9% of (32%) HCl. |
|---|---|---|
| 0 | 0.075 | 0.038 |
| 2 | 0.080 | 0.029 |
| 5 | 0.086 | 0.021 |
| 8 | 0.085 | 0.018 |
| 10 | 0.084 | 0.019 |

EXAMPLE 6

This example illustrates the effect of solvent-to-oil ratio on the content of particulate matter and lead in the oil. The procedure of example 2 was repeated utilizing MIBK containing 2.4% w/w of the 80% $H_2SO_4$, but in various different solvent-to-oil ratios down to 1/1. In one set of experimental tests, the waste oil-solvent mixture was left to settle for 30 minutes prior to decanting off the clarified oil-solvent upper layer. In another set of runs, the oil-solvent mixture, after thorough mixing, was subjected to centrifugation at 5000 rpm for 30 minutes before decanting off the clarified upper layer. In the latter case a very small volume of highly compact sludge was obtained. The lead contents of waste oil treated in the above manner are shown in Table 4.

TABLE 4

Lead content of waste oil after treatment with MIBK containing 2.4% w/w of 80% $H_2SO_4$.

| Solvent/oil ratio | Pb content % w/w, after: Gravity settling | Pb content % w/w, after: Centrifuging |
|---|---|---|
| 4/1 | 0.018% | 0.019% |
| 3/1 | 0.019% | 0.019% |
| 2/1 | 0.021% | 0.018% |
| 1.5/1 | 0.027% | 0.018% |
| 1/1 | 0.037% | 0.032% |

The results given in Table 4 demonstrate that lead content of the waste oil (containing an initial 0.75% w/w lead in oil) could be reduced to less than 3% the amount originally present in the oil, using solvent-to-oil ratio as low as 1.5 to 1. However further reduction in the amount of solvent used resulted in less effective removal of contaminant including lead, from the waste oil.

EXAMPLE 7

This example illustrates the effect of temperature of treatment on the amount of particulate matter and thus lead removed from the waste oil.

The primary procedure of example 1 was repeated utilising solvent of MIBK and 2.4% w/w of the 80% $H_2SO_4$, in the solvent-to-oil ratio of 1/1, but prior to mixing of the waste oil and solvent both were heated to 60° C. in a hot water bath, for at least 30 minutes. The oil-solvent mixture was then centrifuged at 5000 rpm for 30 minutes. Lead content of the waste oil treated at 60° C. is shown in Table 5, and the result compared with that of oil treated in the same manner at 20° C.

TABLE 5

| Lead content of waste oil after treatment at two different temperatures. | |
|---|---|
| Temperature of treatment. | Lead content of treated oil, % w/w |
| 20° C. | 0.032 |
| 60° C. | 0.021 |

The results in Table 5 demonstrate that treatment at higher temperature could result in greater removal of lead and thus other particulate matter from the waste oil, in the case of very low solvent-to-oil ratio. At higher temperature, the viscosity of the oil-solvent mixture is reduced and the movement of the agglomerated particulates through the mixture is greatly facilitated. This resulted in more of the particulate matter being removed within the centrifugation time, compared to the mixture centrifuged at lower temperature. However, at higher solvent-to-oil ratio, the solvent added was probably sufficient to reduce the viscosity of the mixture sufficiently so that it was not the limiting factor in the settlement of agglomerated particulates. Therefore, as demonstrated in Table 4, a solvent to oil ratio as low as 1.5/1 was successful in reducing lead content of the waste oil to less than 3% of that originally present when treatment was carried out at relatively low, i.e. room, temperature.

EXAMPLE 8

This example illustrates use of MEK with varying percentages of sulphuric acid.

The procedure of Example 2 was repeated utilizing MEK and sulphuric acid at different percentages in solvent. Table 6 shows the results of lead content of waste oil after this treatment.

In another set of runs, the oil solvent mixture, after thorough mixing, was subject to centrifugation of 5000 rpm for 30 minutes before decanting off the clarified upper layer. The lead content of this upper layer was then determined.

TABLE 6

| Lead content of waste oil after treatment with MEK containing sulphuric acid. | | |
|---|---|---|
| % w/w $H_2SO_4$ solution in MEK | Pb content, % w/w gravity settling | Pb content, % w/w centrifuging |
| 0.1 | 0.072 | 0.058 |
| 0.3 | 0.071 | 0.024 |
| 0.6 | 0.061 | 0.018 |
| 1.0 | 0.036 | 0.019 |
| 1.3 | 0.028 | 0.019 |
| 2.6 | 0.021 | 0.020 |

A comparison of the data of Table 6 with Table 2 indicates that MEK is not quite as effective as MIBK unless the mixture is centrifuged. When this is done, less acid is required to achieve the maximum reduction in lead content.

EXAMPLE 9

This example demonstrates the effect of using aqueous alkali in place of aqueous acid.

The procedure of example 2 was repeated with the solvent systems comprising MEK and two alkalis used separately. The alkalis used were sodium hydroxide (30% w/w in water) and ammonium hydroxide (30% w/w $NH_3$ in water).

With ammonium hydroxide in MEK, flocculated particulates could be seen settling rapidly soon after termination of mixing, resulting in a descending interface between an upper dark-red oil solvent mixture and a lower layer of black liquor. When the solvent contained 0.5% w/w $NH_4OH$, the settling rate of the particles was comparable to the case of solvent comprising MIBK and 2.8% w/w of $H_2SO_4$ and also MEK containing the same amount of acid. The upper layer of oil-solvent mixture was also very clear. However, with MEK containing different percentages of $NH_4OH$, the upper layer was not as clear.

In the case of solvents comprising MEK and sodium hydroxide, the upper oil-solvent layer was not as clear as with MIBK or MEK and acid, even though the flocculated particulates could be seen settling down quite rapidly.

Lead contents of waste oil after treatment with MEK containing different percentages of the two alkalis, are shown in Table 7.

The data in Table 7 illustrates that ketone containing alkali was only partially successful in reducing the lead content of waste oil, even though in some cases, the solvent appeared to cause a very rapid flocculation and settling of the suspended matters. The lead contents were substantially higher than for waste oil treated with acidified ketone, (i.e., less than 0.02% w/w Pb.)

TABLE 7

| Lead content of waste oil after treatment with MEK containing aqueous alkalis. | | |
|---|---|---|
| % w.w alkali in MEK | Pb content, % w/w (30%) NaOH | Pb content, % w/w (30%) $NH_4OH$ |
| 0.25 | — | 0.073 |
| 0.5 | 0.101 | 0.101 |
| 1.0 | 0.066 | 0.106 |
| 1.5 | 0.056 | — |
| 2.0 | — | 0.097 |
| 2.5 | 0.059 | — |

Moreover, when an oil sample which had been treated with MEK containing 1.0% w/w $NH_4OH$ (and solvent evaporated off) was further treated with an acidified MEK (containing 1.0% w/w $H_2S_4$), lead content was further reduced to 0.015% w/w.

EXAMPLE 10

This example illustrates the effect of using aqueous salts in place of acid.

The procedure of example 2 was repeated with the solvent systems comprising MEK and approximately 4% w/w aqueous salt solutions. The salt solutions were NaCl, $Na_2SO_4$, $NH_4Cl$, $(NH_4)_2SO_4$ and $FeCl_2$, all of which were 5N, except for $Na_2SO_4$ which was saturated. Waste oil was treated with these solvent systems in the solvent-to-oil ratio of 3/1.

In all cases, very rapid flocculation and settling of particulates was observed soon after termination of mixing, resulting in an upper layer of clear, dark red oil-solvent mixture. However, the flocculated particulate phase did not settle clearly and some of the material could be seen adhering to the wall of the containing vessel. The watery sludge layer finally settle to approximately 30% of total volume and did not compact down further even after several days of standing. However a grey layer was seen underneath the black layer after several days.

In another set of experiments, the solvent system of MEK and aqueous salts were used in the solvent-to-oil ratio of 2/1, and the oil-solvent mixture was subjected to centrifugation at 5000 rpm for 30 minutes. The lead content of the oil in the clarified upper layer after centrifugation, was found to be between 0.043 and 0.046% w/w Pb in all cases. The residue after decantation of the clarified oil-solvent layer comprised a small layer of very compact black sludge as well as another layer (approximately 5% of total volume) of sticky dark liquid, similar to that obtained when the oil-solvent mixture was left to settle by gravity.

In a further set of experiments, the initial procedure was repeated with 0.67% of 5M and 1.4M solutions of sodium chloride in water to examine the effect of decreasing the amounts of added water and added salt. After two hours no clarification could be detected visually; an upper clear layer could be seen after 24 hours, but some sludge was still adhering to the wall of the tube.

It was concluded from these experiments that although salt solutions cause flocculation of suspended particulates, they are not as effective as aqueous acids or alkalis.

EXAMPLE 11

This example demonstrates the effect of carbonic acid in MEK.

The production of example 2 was repeated with the solvent system comprising MEK and 5% w/w water, saturated with carbon dioxide ($CO_2$) gas. Very rapid flocculation and settling of particulates was observed, resulting in an upper clear, dark red oil-solvent mixture and a lower black liquor containing settling sludge, soon after termination of mixing. The sludge was very sticky and could be seen adhering to the wall of the containing vessel; the watery sludge layer was found not to compact down with further standing, occupying approximately 30% of total oil-solvent volume even after several days.

With the solvent system comprising MEK and 1% w/w water, saturated with $CO_2$, the oil-solvent mixture remained black for at least 2 hours when left to settle by gravity. However, after 24 hours standing, a clearer, dark red oil-solvent mixture resulted together with a bottom layer of black sludge (approximately 10% of total volume).

It was concluded from these experiments that although carbonic acid causes flocculation of particulates it is not as effective as stronger acids. A higher concentration of carbonic acid, which could be achieved by operating at pressures above atmospheric, could be expected to give improved performance.

It will be clearly understood that the invention in its general aspects is not limited to the specific details referred to hereinabove.

We claim:

1. Process for treating used lubricating oil to reduce the content of suspended particulate matter therein, characterized by contacting said used lubricating oil with a carbonyl-group containing compound in admixture with an aqueous electrolyte selected from the group consisting of inorganic and organic acids, salts and alkalis, separating the resulting mixture into an upper layer containing clarified oil and a lower layer of agglomerated particulates, and recovering oil of reduced particulate content as product.

2. Process according to claim 1 in which the carbonyl-group containing compound is chosen from one or more of the group consisting of ketones, esters and aldehydes.

3. Process according to claim 2 in which the carbonyl-group containing compound is methyl isobutyl ketone and/or methyl ethyl ketone.

4. Process according to claim 1 in which the electrolyte is chosen from one or more of acetic acid, sulphuric acid, hydrochloric acid, carbonic acid, sodium chloride, sodium sulphate, ammonium chloride, ammonium sulphate, ferrous chloride, aluminium sulphate, sodium hydroxide, potassium hydroxide and ammonium hydroxide.

5. Process according to claim 1 including two or more sequential contacting steps employing different electrolytes.

6. Process for treating used lubricating oil to reduce the content of suspended particulate matter therein characterized by contacting said used lubricating oil with a solvent chosen from one or more of methyl ethyl ketone, methyl propyl ketone, methyl isobutyl ketone, diethyl ketone and ethyl acetate, in admixture with an aqueous acid chosen from one or more of acetic acid, sulphuric acid, hydrochloric acid and carbonic acid, separating the resulting mixture into an upper layer containing clarified oil and a lower layer of agglomerated particulates, and recovering oil of reduced particulate content as product.

7. Process for treating used lubricating oil to reduce the content of suspended particulate matter therein, characterized by contacting said used lubricating oil with a solvent chosen from one or more of methyl ethyl ketone, methyl propyl ketone, methyl isobutyl ketone, diethyl ketone and ethyl acetate, in admixture with an aqueous electrolyte chosen from one or more of sodium chloride, sodium sulphate, ammonium chloride, ammonium sulphate, and ferrous chloride, separating the resulting mixture into an upper layer containing clarified oil and a lower layer of agglomerated particulates, and recovering oil of reduced particulate content as product.

8. Process for treating used lubricating oil to reduce the content of suspended particulate matter therein, characterized by contacting said used lubricating oil with a solvent chosen from one or more of methyl ethyl ketone, methyl propyl ketone, methyl isobutyl ketone, diethyl ketone and ethyl acetate, in admixture with an aqueous alkali chosen from one or more of sodium hydroxide, potassium hydroxide and ammonium hydroxide, separating the resulting mixture into an upper layer containing clarified oil and a lower layer of agglomerated particulates, and recovering oil of reduced particulate content as product.

9. Process according to claims 1, 6, 7 or 8, carried out at a temperature from 15° C. to 60° C.

10. Process according to claims 1, 6, 7 or 8 in which the ratio of solvent to oil is from 1.5:1 to 4:1.

* * * * *